US007891957B2

(12) United States Patent
Masao

(10) Patent No.: US 7,891,957 B2
(45) Date of Patent: Feb. 22, 2011

(54) CAPACITY VARIABLE TYPE ROTARY COMPRESSOR AND DRIVING METHOD THEREOF

(75) Inventor: Ozu Masao, Fuji (JP)

(73) Assignee: LG Electronics Inc., Seoul (KR)

( * ) Notice: Subject to any disclaimer, the term of this patent is extended or adjusted under 35 U.S.C. 154(b) by 669 days.

(21) Appl. No.: 11/659,324

(22) PCT Filed: Aug. 4, 2005

(86) PCT No.: PCT/KR2005/002535

§ 371 (c)(1),
(2), (4) Date: Feb. 5, 2007

(87) PCT Pub. No.: WO2006/014079

PCT Pub. Date: Feb. 9, 2006

(65) Prior Publication Data

US 2008/0317610 A1 Dec. 25, 2008

(30) Foreign Application Priority Data

Aug. 6, 2004 (KR) ..... 10-2004-0062102

(51) Int. Cl.
*F04B 49/00* (2006.01)
*F04B 23/00* (2006.01)

(52) U.S. Cl. ..... 417/310; 417/440

(58) Field of Classification Search ..... 417/310, 417/440, 304, 307, 283; 418/64; 137/652.43, 137/596.12–596.14

See application file for complete search history.

(56) References Cited

U.S. PATENT DOCUMENTS 2,976,701 A * 3/1961 Greenawalt ..... 62/324.6

(Continued)

FOREIGN PATENT DOCUMENTS

EP 0354867 2/1990

(Continued)

*Primary Examiner*—Charles G Freay
*Assistant Examiner*—Alexander B Comley
(74) *Attorney, Agent, or Firm*—KED & Associates LLP

(57) ABSTRACT

Disclosed is a capacity variable type rotary compressor and a driving method thereof. In the compressor, a first discharge port (11) is formed at a cylinder (10), a second discharge port (23) connected to the first discharge port (14) for discharging compressed gas into a casing (1) is formed at a main bearing (20), and a bypass hole (22) having a bypass valve (80) for providing compressed refrigerant gas to an inlet (12) is formed at the main bearing (20) between the first discharge port (14) and the second discharge port (23). ccordingly, a cooling capability is greatly lowered at the time of performing a capacity exclusion driving of the compressor, and the capacity exclusion driving can be maintained for a long time, thereby variously controlling an air conditioner and reducing unnecessary power waste of the compressor and the air conditioner to which the compressor is applied. Also, since a back pressure of a sliding valve (81) is fast and precisely switched by using a pilot valve (90) having a cheap cost and a high reliability, the method can be widely applied to a compressor or an air conditioner having a function for frequently varying a cooling capability. Therefore, the efficiency of the compressor or the air conditioner is prevented from being lowered. Besides, a bypass valve (110) is installed outside a casing of the compressor, thereby removing an additional back pressure switching unit and thus simplifying the entire system.

10 Claims, 5 Drawing Sheets

U.S. PATENT DOCUMENTS 4,558,993 A * 12/1985 Hori et al. ..... 417/283
4,805,666 A * 2/1989 Araki et al. ..... 137/625.43
4,889,474 A * 12/1989 Nakajima et al. ..... 417/295
4,890,986 A * 1/1990 Taguchi et al. ..... 417/295
4,892,466 A * 1/1990 Taguchi et al. ..... 417/295
5,030,066 A * 7/1991 Aihara et al. ..... 417/295
5,074,761 A * 12/1991 Hirooka et al. ..... 417/310
6,089,830 A 7/2000 Harte et al.
6,551,069 B2 * 4/2003 Narney et al. ..... 417/53
6,616,419 B2 * 9/2003 Watanabe et al. ..... 417/220
6,663,358 B2 * 12/2003 Loprete et al. ..... 417/313
6,830,073 B2 * 12/2004 Lee ..... 137/625.43

FOREIGN PATENT DOCUMENTS

JP 01155163 6/1989
JP 04094495 3/1992
JP 2003-314912 11/2003

* cited by examiner

CAPACITY VARIABLE TYPE ROTARY COMPRESSOR AND DRIVING METHOD THEREOF

TECHNICAL FIELD

The present invention relates to a capacity variable type rotary compressor, and more particularly, to a capacity variable type rotary compressor capable of controlling a cooling capability by discharging refrigerant gas of a compression chamber if necessary, and a driving method thereof.

BACKGROUND ART

A rotary compressor is mainly applied to an air conditioner. Recently, as the air conditioner has various functions, a capacity variable type rotary compressor is being required.

As technique for varying a capacity of the rotary compressor, an inverter method for controlling rpm of the rotary compressor by applying an inverter motor has been well known. However, the technique has the following disadvantages. First, since the inverter motor is expensive, a fabrication cost is increased. Second, since the air conditioner is used as a cooling apparatus, a process for enhancing a cooling capability in a cooling condition is more difficult than a process for enhancing a cooling capability in a heating condition.

Accordingly, recently, a cooling capability varying technique by an exclusion capacity switching (hereinafter, will be called as an exclusion capacity switching technique) for varying a capacity of a compression chamber by bypassing a part of refrigerant gas compressed in a cylinder outside the cylinder is being introduced instead of the inverter method.

As the exclusion capacity switching technique, a digital compression technique for controlling a cooling capability by combining a saving driving (hereinafter, 'mode 0 driving') for making a cooling capability be zero by temporarily stopping a compressor being operated with a power driving (hereinafter, 'mode 1 driving') for driving a compressor with 100% is being introduced.

For example, if the mode 1 driving is performed for 7 seconds and the mode 0 driving is performed for 3 seconds, a cooling capability corresponding to 70% is obtained for the total 10 seconds. A compressor for controlling a cooling capability by controlling the mode 1 driving and the mode 0 driving by time is called as a digital compressor. The digital compressor can be fabricated with a cheap cost since an inverter is not required, and has an excellent efficiency and reliability.

However, most of the digital compression techniques have not been applied to a concrete driving mechanism of a rotary compressor whereas the digital compression technique has been applied to a scroll compressor for utility.

DISCLOSURE OF THE INVENTION

Therefore, an object of the present invention is to provide a capacity variable type rotary compressor having a practical mechanism based on a digital compression technique and a driving method thereof.

To achieve these and other advantages and in accordance with the purpose of the present invention, as embodied and broadly described herein, there is provided a capacity variable type rotary compressor, comprising: a casing having a gas suction pipe connected to an evaporator and a gas discharge pipe connected to a condenser; a cylinder fixed in the casing, having an inner space at a center thereof for compressing a refrigerant as a rolling piston performs an orbit motion, having an inlet penetratingly formed at the inner space in a radial direction to be connected to the gas suction pipe, having a vane slit in a radial direction, the vane slit for supporting a vane that divides the inner space into a compression chamber and a suction chamber by contacting the rolling piston in a radial direction, and having a discharge port for discharging refrigerant gas at a circumferential surface thereof; a plurality of bearing plates for covering upper and lower sides of the cylinder and thereby sealing the inner space, having a bypass hole for connecting the discharge port of the cylinder to the inlet at one bearing plate, and having another discharge port for discharging compression gas into the casing at the center of the bypass hole; a plurality of discharge valves installed at an end of each discharge port for opening and closing the discharge ports; a capacity varying unit coupled to the bearing plate for selectively opening and closing the bypass hole of the bearing plate and thereby discharging a part of a compressed refrigerant to the inlet; and a back pressure switching unit for differently supplying a back pressure to the capacity varying unit so that the capacity varying unit can open or close the bypass hole according to a driving mode of the compressor.

According to another embodiment of the present invention, the capacity variable type rotary compressor comprises: a casing having a gas suction pipe connected to an evaporator and a gas discharge pipe connected to a condenser; a cylinder fixed in the casing, having an inner space at a center thereof for compressing a refrigerant as a rolling piston performs an orbit motion, having an inlet penetratingly formed at the inner space in a radial direction to be connected to the gas suction pipe, having a vane slit in a radial direction, the vane slit for supporting a vane that divides the inner space into a compression chamber and a suction chamber by contacting the rolling piston in a radial direction, and having a discharge port for discharging refrigerant gas at a circumferential surface thereof; a plurality of bearing plates for covering upper and lower sides of the cylinder and thereby sealing the inner space, and having another discharge port for discharging compression gas discharged from the discharge port of the cylinder into the casing; a plurality of discharge valves installed at an end of the each discharge port for opening and closing the discharge ports; a bypass pipe for connecting a refrigerant pipe between the discharge port of the cylinder and the discharge port of the bearing plate to the inlet of the cylinder; and a capacity varying unit installed in the middle of the bypass pipe for selectively opening and closing the bypass pipe of the bearing plate and thereby discharging a part of a compressed refrigerant to the inlet.

To achieve these and other advantages and in accordance with the purpose of the present invention, as embodied and broadly described herein, there is also provided a method for driving a capacity variable type rotary compressor, comprising consecutively performing a power driving mode for implementing a maximum cooling capability by driving the rotary compressor under a state that a capacity varying unit closes a bypass hole or a bypass pipe, and a saving driving mode for discharging an entire compressed refrigerant of a cylinder to a suction chamber of the cylinder as the capacity varying unit opens the bypass hole or the bypass pipe when a lowering of a cooling capability is required while the power driving mode is performed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

MODES FOR CARRYING OUT THE PREFERRED EMBODIMENTS

Reference will now be made in detail to the preferred embodiments of the present invention, examples of which are illustrated in the accompanying drawings.

Hereinafter, a capacity variable type rotary compressor and a driving method thereof according to the present invention will be explained in more detail with reference to one embodiment of the attached drawings.

Figure 1:
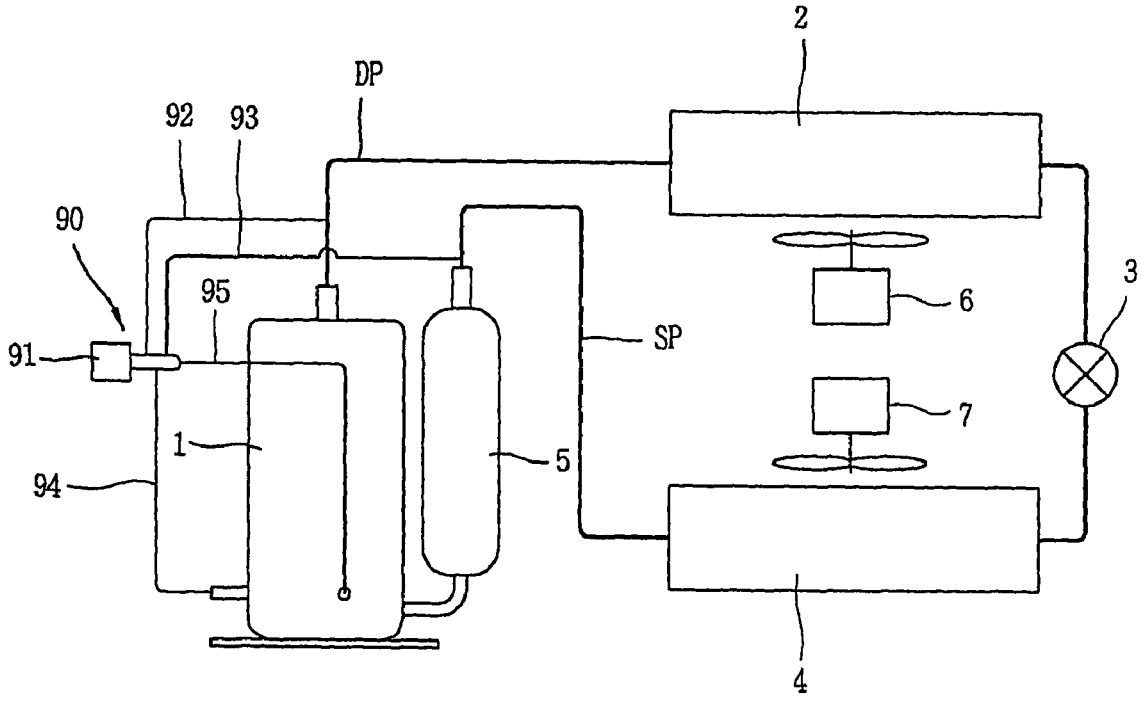
FIG. 1 is a pipe diagram showing an air conditioner having a capacity variable type rotary compressor according to the present invention.
Figure 2:
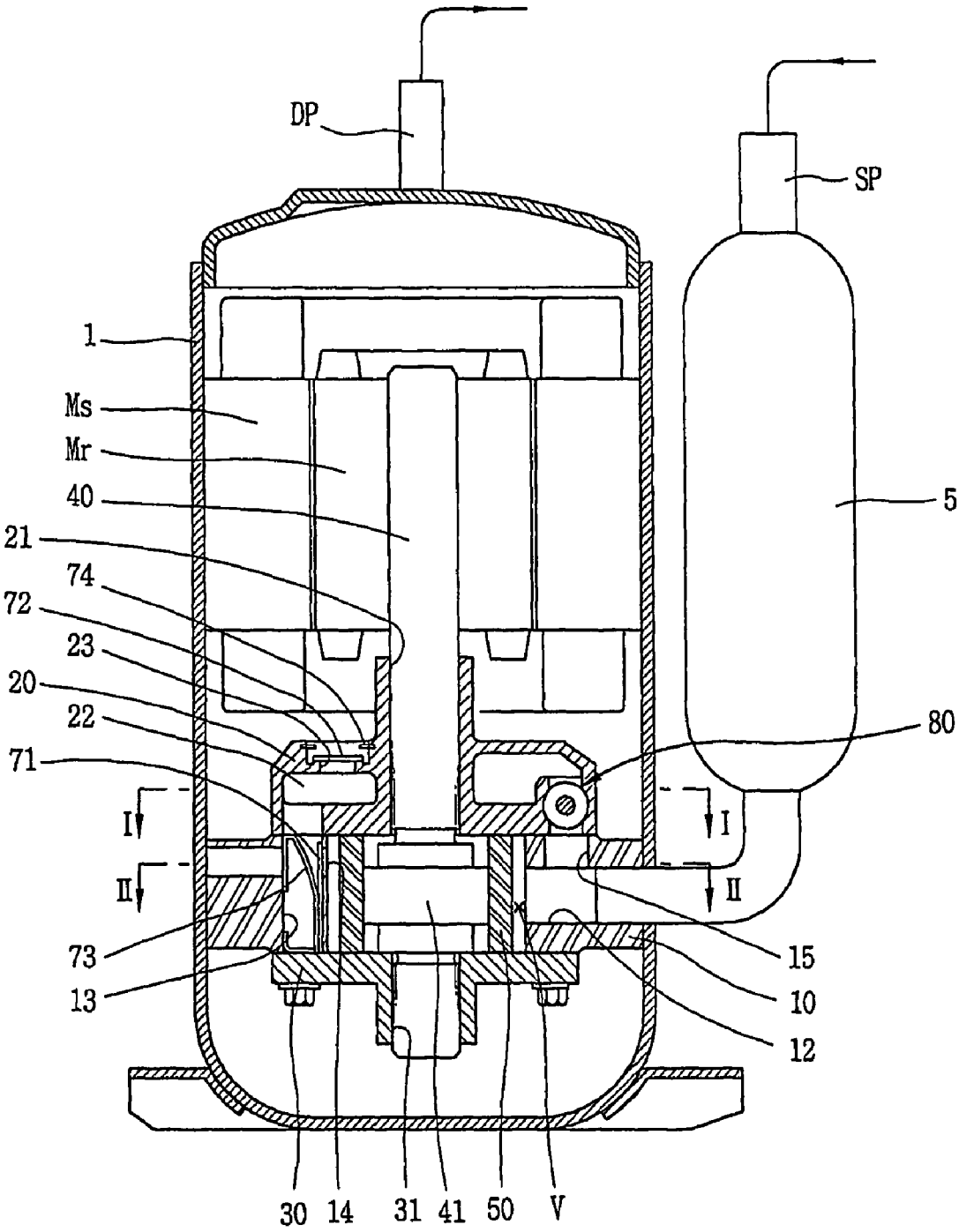
FIG. 2 is a sectional view taken along line III-III in FIG. 3, which shows one embodiment of the capacity variable type rotary compressor according to the present invention.
Figure 3:
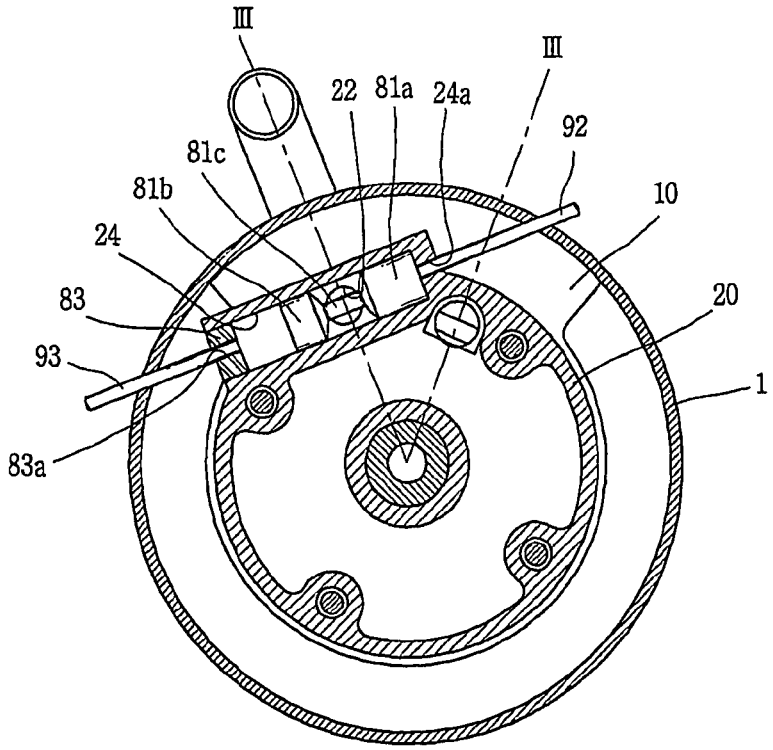
FIG. 3 is a sectional view taken along line I-I in FIG. 2.
Figure 4:
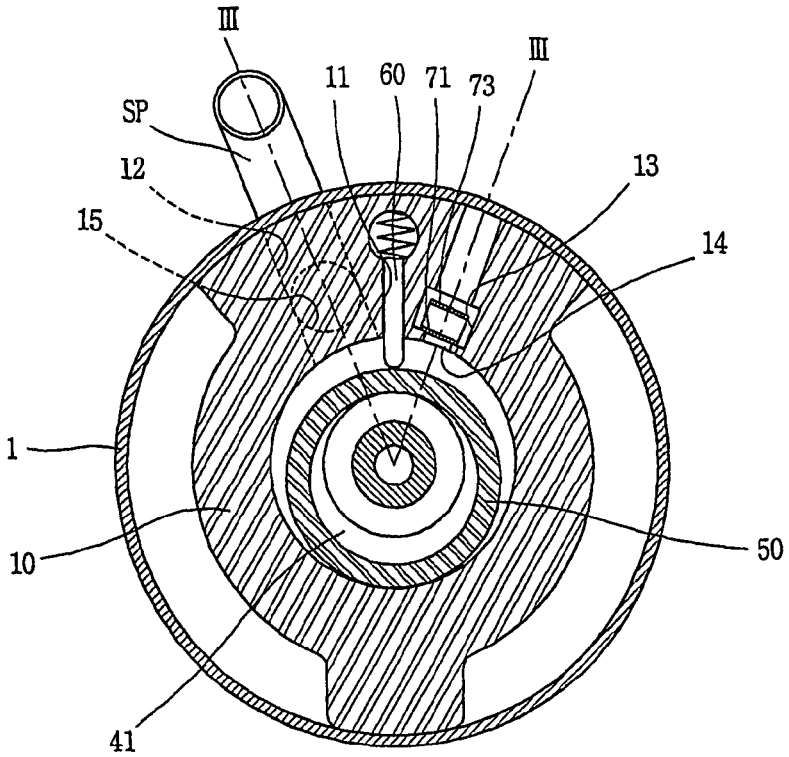
FIG. 4 is a sectional view taken along line II-II in FIG. 2.
Figure 5:
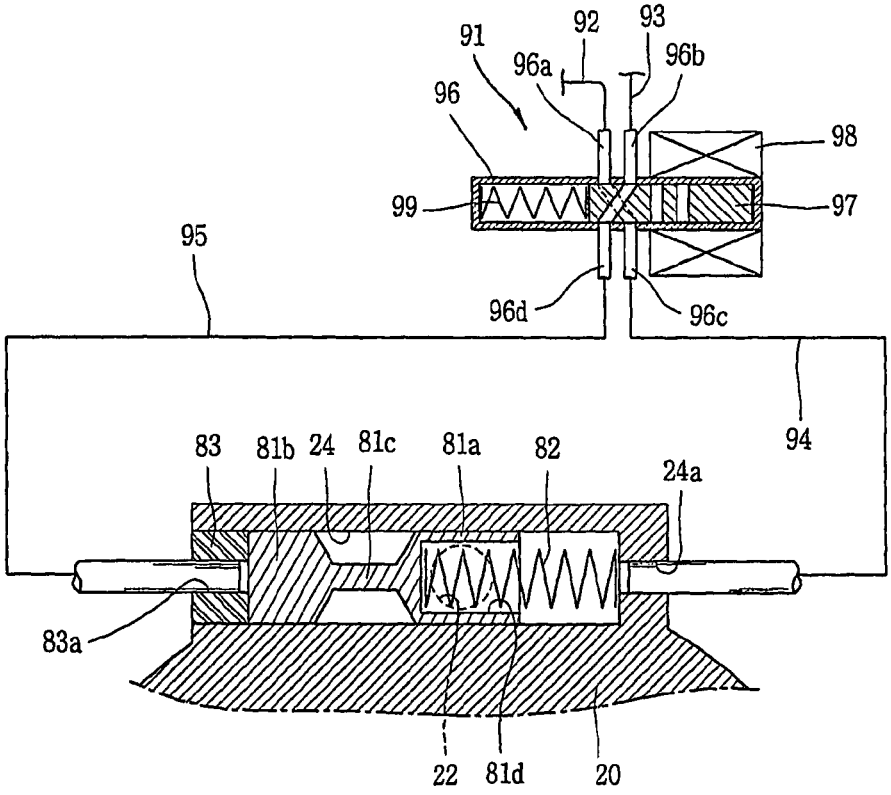
FIGS. 5 and 6 are sectional views respectively showing a power driving and a saving driving in the capacity variable type rotary compressor according to the present invention.
Figure 6:
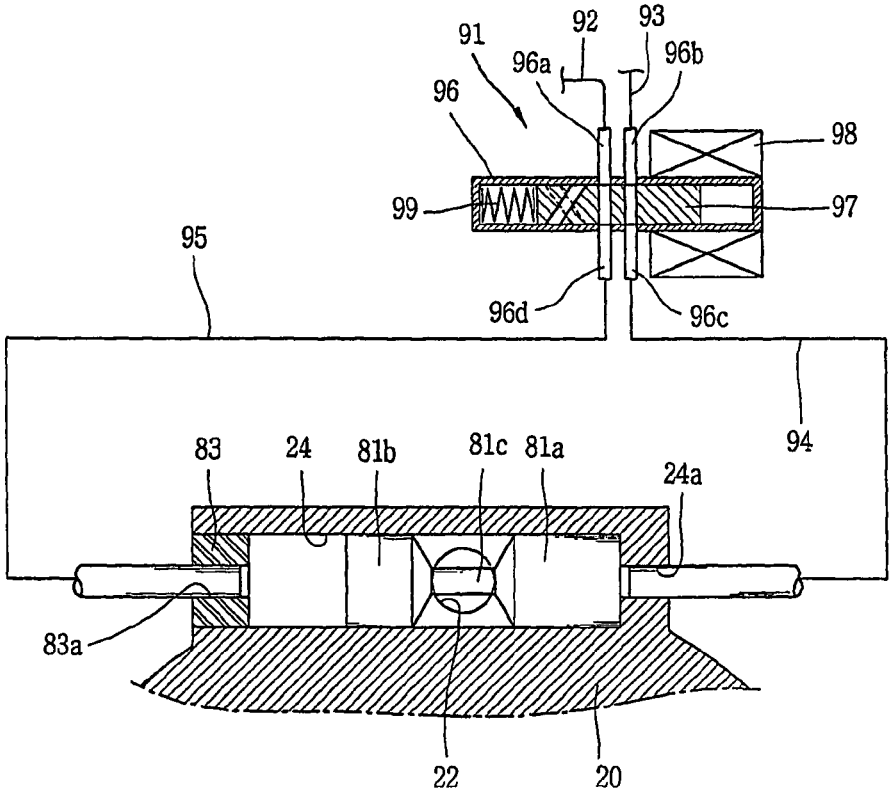

FIG. 1 is a pipe diagram showing an air conditioner having a capacity variable type rotary compressor according to the present invention, FIG. 2 is a sectional view taken along line III-III in FIG. 3, which shows one embodiment of the capacity variable type rotary compressor according to the present invention, FIG. 3 is a sectional view taken along line I-I in FIG. 2, FIG. 4 is a sectional view taken along line II-II in FIG. 2, and FIGS. 5 and 6 are sectional views respectively showing a power driving and a saving driving in the capacity variable type rotary compressor according to the present invention.

As shown, the rotary compressor according to the present invention comprises a casing 1 to which a gas suction pipe SP and a gas discharge pipe DP are connected, a motor unit installed at an upper side of the casing 1 for generating a rotation force, and a compression unit installed at a lower side of the casing 1 for compressing a refrigerant by the rotation force generated from the motor unit.

The motor unit is composed of a stator Ms fixed in the casing 1 and receiving a power applied from outside, and a rotor Mr arranged in the stator Ms with a certain air gap and rotated while reciprocally operated with the stator Ms.

The compression unit comprises a cylinder 10 having a ring shape and installed in the casing 1, a main bearing plate (hereinafter, will be called as a main bearing) 20 and a sub bearing plate (hereinafter, will be called as a sub bearing) 30 for covering upper and lower sides of the cylinder 10 and thereby forming an inner space V, a rotation shaft 40 inserted into the rotor Mr and supported by the main bearing 20 and the sub bearing 30 for transmitting a rotation force, a rolling piston 50 rotatably coupled to an eccentric portion 41 of the rotation shaft 40 and performing an orbit motion at the inner space of the cylinder 10 for compressing a refrigerant, a vane 60 coupled to the cylinder 10 to be movable in a radial direction so as to contact an outer circumferential surface of the rolling piston 50 for dividing the inner space V of the cylinder 10 into a suction chamber and a compression chamber, and a discharge valve 71 coupled to an end of a discharge port 14 of the main bearing 20 to be opened and closed.

The compression unit further comprises a capacity varying unit 80 provided at one side of the main bearing 20 for varying a capacity of the compression chamber, and a back pressure switching unit 90 connected to the capacity varying unit 80 for operating the capacity varying unit 80 by a pressure difference according to a driving mode of the compressor.

The cylinder 10 is formed as a ring shape so that the rolling piston 50 can perform a relative motion, and a vane slit 11 is formed at one side of the cylinder 10 as a linear shape so that the vane 60 can perform a linear motion in a radial direction. Also, an inlet 12 connected to the gas suction pipe SP is penetratingly formed in a radial direction of the cylinder at one side of the vane slit 11. A first connection hole 13 is penetratingly formed at an opposite side to the inlet 12 in parallel with a second discharge port 23 of the main bearing that will be later explained in the shaft direction as a square shape at the time of a plane projection. A first discharge port 14 penetrating the inner space V of the cylinder 10 in a radial direction and opened/closed by a first discharge valve 71 that will be later explained is formed at one side of the first connection hole 13. Also, a second connection hole 15 for connecting the first connection hole 13 and the inlet 12 by a bypass hole 22 that will be later explained is formed at a part perpendicular to the inlet 12.

The main bearing 20 comprises a bearing hole 21 formed at the center thereof for supporting the rotation shaft 40 in a radial direction, a bypass hole 22 formed in the main bearing 20 for connecting the first connection hole 13 and the second connection hole 15 of the cylinder 10, a second discharge port 23 formed in the middle of the bypass hole 22 and at one side of the vane slit 11 of the cylinder 10 and having a second discharge valve 72 for discharging a compressed refrigerant into the casing 1, and a valve hole 24 formed in the middle of the bypass hole 22 between the second discharge port 23 and the second connection hole 15 in a direction perpendicular to the vane slit 11 for inserting a sliding valve 81 of the capacity varying unit 80 that will be later explained.

The second discharge port 23 is formed to have the same diameter as the first discharge port 14 at a position corresponding to approximately 345° in a direction that the rolling piston 50 is rotated on the basis of the vane slit 11. Also, the bypass hole 22 is preferably formed to have an approximate same diameter as that of the first connection hole 13 or the second connection hole 15.

The valve hole 24 is formed at an outer circumferential surface of one side of the main bearing 20 as a certain depth. Also, a lateral surface of the valve hole 24 is formed as a wall surface for supporting one end of a valve spring 82 that will be later explained or supporting a rear surface of a first pressure unit 81*a* of the sliding valve 81. Another end of the valve hole 24 is opened, and a valve stopper 83 for supporting a rear surface of a second pressure unit 81*b* of the sliding valve 81 is inserted thereinto.

A first back pressure hole 24*a* and a second back pressure hole 83*a* for supplying a high pressure atmosphere or a low pressure atmosphere to the sliding valve 81 by connecting a first connection pipe 94 and a second connection pipe 95 of the back pressure switching unit 90 are respectively formed at the center of the wall surface of the valve hole 24 and the center of the valve stopper 83.

As shown in FIGS. 3 to 6, the capacity varying unit 80 comprises a sliding valve 81 slidably inserted into the valve hole 24 and moved in the valve hole 24 by a pressure difference due to the back pressure switching unit 90 for opening and closing the bypass hole 22, at least one valve spring 82 for elastically supporting a motion direction of the sliding valve 81 and moving the sliding valve 81 in a position to close the bypass hole 22 when both ends of the valve spring have the same pressure, and a valve stopper 83 for closing the valve hole 24 in order to prevent the sliding valve 81 from being separated from the valve hole 24.

The sliding valve 81 comprises a first pressure unit 81*a* slidably contacting an inner circumferential surface of the valve hole 24 and positioned at the wall surface of the valve hole 24 for opening and closing the bypass hole 22 by receiving a pressure from the back pressure switching unit 90, a second pressure unit 81*b* slidably contacting an inner circumferential surface of the valve hole 24 and positioned at the valve stopper 83 for opening and closing the bypass hole 22 by receiving a pressure from the back pressure switching unit 90, and a connection unit 81*c* for connecting the two pressure units 81*a* and 81*b* and having a gas passage between an outer circumferential surface thereof and the valve hole 24 so as to be connected to the bypass hole 22.

The first pressure unit 81*a* is formed to be longer than a diameter of the bypass hole 22. Preferably, a spring fixing groove 81*d* for inserting the valve spring 82 is formed at a rear end of the first pressure unit 81*a* towards the center of the first pressure unit 81*a* in order to minimize a valve length.

The back pressure switching unit 90 comprises a pressure switching valve assembly 91 connected to the gas suction pipe SP and the gas discharge pipe DP for connecting the capacity varying unit 80 to the gas suction pipe SP and the gas discharge pipe DP arranged at both sides of the capacity varying unit 80 by alteration, a high pressure connection pipe 92 for connecting a high pressure side inlet 96*a* of the pressure switching valve assembly 91 to the gas discharge pipe DP, a low pressure connection pipe 93 for connecting a low pressure side inlet 96*b* of the pressure switching valve assembly 91 to the gas suction pipe SP, a first connection pipe 94 for connecting a first outlet 96*c* of the pressure switching valve assembly 91 to the first pressure unit 81*a* of the capacity varying unit 80, and a second connection pipe 95 for connecting a second outlet 96*d* of the pressure switching valve assembly 91 to the second pressure unit 81*b* of the capacity varying unit 80.

The pressure switching valve assembly 91 comprises a switching valve housing 96 for forming the high pressure side inlet 96*a* connected to the gas discharge pipe DP, the low pressure side inlet 96*b* connected to the gas suction pipe SP, the first outlet 96*c* connected to the first connection pipe 94, and the second outlet 96*d* connected to the second connection pipe 95; a switching valve 97 slidably coupled to inside of the switching valve housing 96 for selectively connecting the low pressure side inlet 96*b* to the first outlet 96*c* and the high pressure side inlet 96*a* to the second outlet 96*d*, or connecting the low pressure side inlet 96*b* to the second outlet 96*d* and the high pressure side inlet 96*a* to the first outlet 96*c*; an electromagnet 98 installed at one side of the switching valve housing 96 for moving the switching valve 97 by an applied power; and a switching valve spring 99 formed as a compression spring for restoring the switching valve 97 when the power applied to the electromagnet 98 is cut off.

Preferably, the electromagnet 98 has a small size and requires a consumption power less than approximately 15 Watt/Hour in order to enhance a reliability and to reduce a fabrication cost and a consumption power.

An unexplained reference numeral 2 denotes a condenser, 3 denotes an expander, 4 denotes evaporator, 5 denotes an accumulator, 6 denotes a condenser blowing fan, 7 denotes an evaporator blowing fan, 31 denotes a bearing hole, 73 denotes a first discharge valve stopper, and 74 denotes a second discharge valve stopper.

An operation of the capacity variable type rotary compressor according to the present invention will be explained as follows.

When power is supplied to the motor unit, the rotation shaft 40 is rotated and the rolling piston 50 performs an orbit motion at the inner space V of the cylinder 10 thereby to form a capacity between the vane 60. The rolling piston 50 sucks a refrigerant into the capacity, compresses the refrigerant, and then discharges the refrigerant into the casing 1. The refrigerant gas is discharged to the condenser 2 of the refrigerating cycle apparatus through the gas discharge pipe DP, then sequentially passes through the expander 3 and the evaporator 4, and then is sucked into the inner space V of the cylinder 10 through the gas suction pipe SP, which is repeated.

The capacity variable type rotary compressor performs a mode 0 driving (a saving driving) or a mode 1 driving (power driving) according to a driving state of an air conditioner to which the capacity variable type rotary compressor is applied, which will be explained in more detail as follows.

When the compressor is stopped and the system is in an equalized pressure state, the sliding valve 81 has the same pressure at both ends thereof. Accordingly, the sliding valve 81 is moved to the left side of the drawing by the valve spring 82 as shown in FIG. 5 and stops. The bypass hole 22 is closed by the first pressure unit 81*a* of the sliding valve 81.

Under the state, if the compressor is operated, the refrigerant sucked into the compressor through the inlet 12 of the cylinder 10 is compressed by the rolling piston 50 thereby to be in a high pressure, and is introduced into the bypass hole 22 through the first outlet 14 and the first connection hole 13. The refrigerant gas overcomes the second discharge valve 72 as the sliding valve 81 closed the bypass hole 22, and is discharged into the casing 1 through the second discharge port 23. Then, 10 the refrigerant gas circulates the condenser 2, the expander 3, and the evaporator 4, thereby performing a compression driving for implementing a cooling capability of 100% which is called as a mode 1 driving.

Under the state, if the compressor is continuously operated, a high pressure is maintained from the compressor to the expander 3 and a low pressure is maintained from the expander 3 to the gas suction pipe SP thereby to generate a pressure difference between a high pressure and a low pressure. Generally, one minute is sufficient to generate the pressure difference. If the electromagnet 98 of the back pressure switching unit 90 is turned off, the first connection pipe 94 is connected to the high pressure side inlet 96*a* and the second connection pipe 95 is connected to the low pressure side inlet 96*b*. As the result, as shown in FIG. 5, the first pressure unit 81*a* of the sliding valve 81 closes the bypass hole 22 (the mode 1 driving).

On the contrary, as shown in FIG. 6, if the power applied to the electromagnet 98 of the back pressure switching unit 90, a pilot valve is turned on, the switching valve 97 moves by overcoming the elastic force of the switching valve spring 99, thereby connecting the high pressure side outlet 96*a* to the second connection pipe 95 and connecting the low pressure side inlet 96*b* to the first connection pipe 94. Accordingly, the refrigerant gas of a high pressure of the gas discharge pipe DP is introduced into the second pressure unit 81*b* of the sliding valve 81 via the second connection pipe 95. Then, the sliding valve 81 overcomes the elastic force of the valve spring 82 and moves to the right side of the drawing as a high pressure atmosphere is formed at a pressure surface of the second pressure unit 81*b*. Accordingly, the connection unit 81*c* of the sliding valve 81 is positioned in the middle of the bypass hole 22 and opens the bypass hole 22. The refrigerant gas introduced into the bypass hole 22 through the first discharge port 14 of the cylinder 10 is not discharged to the second discharge port 23 by the inner pressure of the casing 1 relatively having a high pressure, but backflows to the inlet 12 of the cylinder 10 through the bypass hole 22 and the second connection hole 15. Accordingly, the compressor performs a saving driving, that is, a non-compression driving having a cooling capability of 0%, which is called as a mode 2 driving.

When the compressor is to be stopped, the compressor can be stopped in the mode. 1 driving or the mode 0 driving. Since the mode 1 driving is a compression driving and the mode 0 driving is a non-compression driving, the compressor is preferably stopped in the mode 0 driving in order to reduce vibration of the compressor. When a long time lapses after the compressor is stopped, for example, more than 3 minutes, a pressure difference for maintaining the mode 0 driving disappears and thereby the compressor has to be operated in the mode 1 driving.

How long the mode 0 driving has to be maintained or whether the compressor can be operated in the mode 0 driving after being stopped, etc. are determined according to whether a pressure difference between a high pressure and a low pressure for maintaining the mode 0 driving is generated or not. The pressure difference is obtained by using a differential pressure sensor, and whether the pressure difference is generated or not is judged by detecting an operation duration time of the compressor after being switched into the mode 0 driving from the mode 1 driving, the time that the compressor has been stopped, and the temperature of the condenser 2 and the evaporator 4. If the temperature of the condenser 2 and the evaporator 4 is within a preset range, it is judged that the pressure difference is generated. Among the above detection factors, the temperature of the condenser 2 and the evaporator 4 is the most advantageous in the economic aspect.

A process for controlling a cooling capability of the capacity variable type rotary compressor according to the present invention will be explained as follows.

When the compressor is operated, the system continues to perform a normal driving in the mode 1 driving due to a normal refrigerating cycle subsequent to an abnormal refrigerating cycle. When an indoor temperature approaches to a preset temperature, the cooling capability is gradually lowered since the cooling capability is excessive in the mode 1 driving thereby to reach the indoor temperature to the preset temperature. For example, in case of lowering the cooling capability (Qm) into 80%, a driving time ratio (m) between the mode 1 driving and the mode 0 driving is set to be 4:1.

That is, m=mode 1 driving/(mode 1 driving+mode 0 driving)=0.8

Cooling capability (Qm)=0.8×100%=80%

In case of lowering the cooling capability, for example, into 20%, the m has to be set to be 0.2. The driving time ratio (m) between the mode 1 driving and the mode 0 driving has to be 1:4.

In case of using a mode S (stopping) driving, the mode 0 driving is substituted by the mode S driving. In case of controlling the compressor in the mode 0 driving, there is a component loss, a motor loss, and a gas resistance loss even under no-load state, and a consumption power more than 10% of that required in the mode 1 driving is necessary. However, the mode S driving has a zero loss since the compressor is stopped.

Another embodiment of the capacity variable type rotary compressor according to the present invention will be explained as follows.

Figure 7:
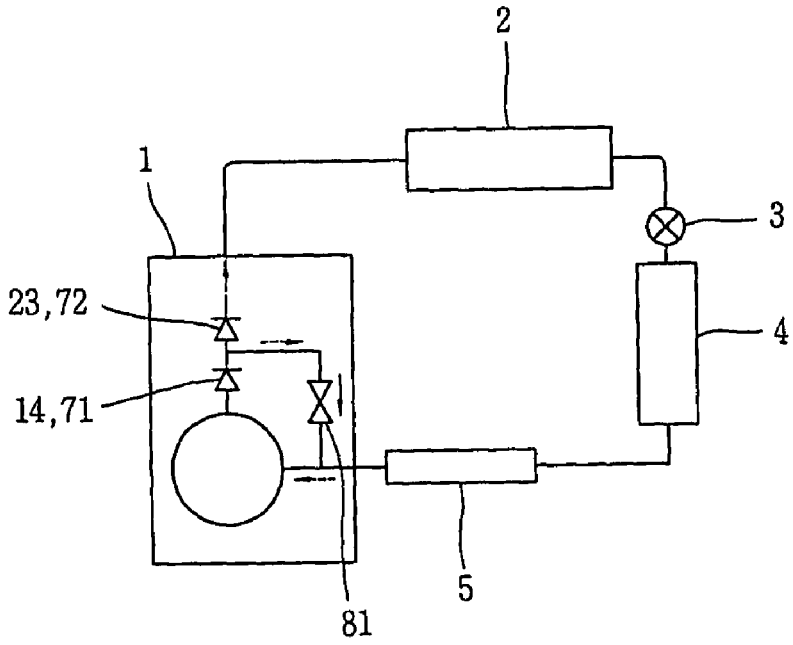
FIG. 7 is a piping diagram showing a refrigerant flow in an air conditioner having the capacity variable type rotary compressor according to the present invention.
Figure 8:
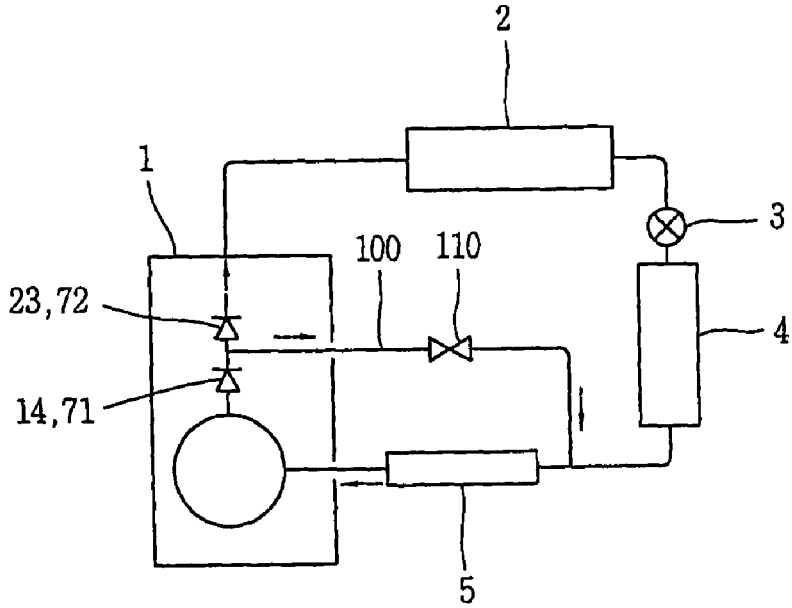
FIG. 8 is a piping diagram showing a refrigerant flow in an air conditioner having the capacity variable type rotary compressor according to another embodiment of the present invention.

In the aforementioned embodiment, the capacity varying unit is installed in the casing of the compressor as shown in FIG. 7. However, in another embodiment of the present invention, the capacity varying unit is installed outside the casing of the compressor as shown in FIG. 8.

Concretely speaking, a bypass pipe 100 is extendingly formed from the first connection hole 13 between the first discharge port 14 of the cylinder 10 and the second discharge port 23 of the main bearing 20 towards outside of the casing 1. Another end of the bypass pipe 100 is connected to the gas suction pipe SP, more precisely, to an inlet of the accumulator 5. A magnet valve 110 for opening and closing the bypass pipe 100 is installed in the middle of the bypass pipe 100.

When the magnet valve 110 is closed, the capacity variable type rotary compressor according to the present invention performs a compression driving (mode 1 driving) for implementing a cooling capability of 100%. However, when the magnet valve 110 is opened, the capacity variable type rotary compressor performs a non-compression driving (mode 0 driving) for implementing a cooling capability of 0% by bypassing a refrigerant gas discharged through the first discharge port 13 of the cylinder 10 to a low pressure side of the system such as the accumulator 5, etc.

According to another embodiment of the present invention, the back. pressure switching unit 90 for driving the capacity varying unit 80 can be removed, and the capacity varying unit 80 needs not be installed in the casing 1 of the compressor, thereby simplifying the structure more than in the aforementioned embodiment.

Accordingly, the rotary compressor mainly applied to a domestic air conditioner is fabricated with a cheap cost and is easily controlled, thereby enhancing the reliability of the compressor.

In the capacity variable type rotary compressor of the present invention, the mode switching is frequently performed between the mode 1 driving and the mode 0 driving, thereby controlling the cooling capability. Also, the cooling capability can be arbitrarily controlled within a range corresponding to 100% to 20% by controlling the driving time in the mode 1 driving and the mode 0 driving, thereby lowering the fabrication cost and enhancing the efficiency and the reliability than in the inverter rotary compressor.

Also, in the present invention, the refrigerant is bypassed by using the back pressure switching unit having a cheap cost and a high reliability, thereby reducing a consumption power necessary to perform a mode switching and enhancing the reliability.

Besides, in the present invention, the discharge port is formed at the circumferential surface of the cylinder, thereby preventing a dead volume from being increased and the efficiency from being lowered.

Also, in the present invention, the bypass hole is closed when the compressor is stopped, thereby enabling a compression function to be immediately performed when the compressor is operated and thus enhancing the function of the compressor.

The capacity variable type rotary compressor and the driving method thereof according to the present invention are applied to a refrigerating cycle apparatus constituting home electronics, and is particularly applied to an air conditioner having the refrigerating cycle apparatus, thereby enhancing the efficiency of the air conditioner and lowering the consumption power.

In the capacity variable type rotary compressor and the driving method thereof according to the present invention, the first discharge port is formed at the cylinder, the second discharge port connected to the first discharge port for discharging compressed gas into the casing is formed at the main bearing, and the bypass hole having the bypass valve for providing compressed refrigerant gas to the inlet is formed at the main bearing between the first discharge port and the second discharge port. Accordingly, the cooling capability is greatly lowered at the time of performing the capacity exclusion driving of the compressor, and the capacity exclusion driving can be maintained for a long time, thereby variously controlling the air conditioner and reducing unnecessary power waste of the compressor and the air conditioner to which the compressor is applied.

Also, since a back pressure of the sliding valve is fast and precisely switched by using the pilot valve having a cheap cost and a high reliability, the method of the present invention can be widely applied to a compressor or an air conditioner having a function for frequently varying a cooling capability. Therefore, the efficiency of the compressor or the air conditioner is prevented from being lowered.

Besides, in the present invention, the bypass valve is installed outside the compressor casing, thereby removing the back pressure switching unit and thus simplifying the entire system.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A capacity variable type rotary compressor, comprising:

a casing having a gas suction pipe configured to be connected to an evaporator and a gas discharge pipe configured to be connected to a condenser;

a cylinder fixed in the casing, the cylinder including an inner space at a center thereof that compresses a refrigerant as a rolling piston performs an orbit motion, an inlet penetratingly formed at the inner space and extending in a radial direction that is connected to the gas suction pipe, a vane slit that extends in a radial direction and supports a vane that divides the inner space into a compression chamber and a suction chamber by contacting the rolling piston in a radial direction, a first discharge port that discharges compressed refrigerant gas at a circumferential surface thereof, a first connection hole that is connected with the first discharge port, and a second connection hole that is connected with the inlet;

a first bearing plate that covers an upper side of the cylinder first bearing plate including a bypass hole that connects the first connection hole to the second connection hole, a second discharge port that discharges the compressed refrigerant gas discharged through the first discharge port into the casing provided at a middle of the bypass hole, and a valve hole into which a sliding valve is slidably inserted;

a second bearing plate that covers a lower side of the cylinder;

a first discharge valve and a second discharge valve, respectively, installed at an end of the first and second discharge ports that open and close the first and second discharge ports;

a capacity varying device that selectively discharges a part of the compressed refrigerant gas into the inner space of the cylinder; and a back pressure switching device that supplies a back pressure to the capacity varying device so that the capacity varying device opens and closes the bypass hole according to a driving mode of the compressor, wherein the back pressure switching device comprises:

a pressure switching valve assembly connected to the gas suction pipe and the gas discharge pipe that connects the capacity varying device to the gas suction pipe and the gas discharge pipe arranged at both sides of the capacity varying device by alteration;

a first connection pipe that connects a first outlet of the pressure switching valve assembly to one side of the valve hole; and a second connection pipe that connects a second outlet of the pressure switching valve assembly to another side of the valve hole.

2. The compressor of claim 1, wherein the first and second discharge ports are respectively formed at a maximum compression angle.

3. The compressor of claim 1, wherein the first and second discharge ports are formed to have the same diameter.

4. The compressor of claim 1, wherein the first and second discharge ports are formed to have a same elastic coefficient.

5. The compressor of claim 1, wherein the sliding valve is slidably inserted into the valve hole and moved in the valve hole by a pressure difference due to the back pressure switching device, that opens and closes the bypass hole, and wherein the sliding valve is elastically supported by at least one valve spring and is moved in a position that closes the bypass hole when both ends of the valve spring have the same pressure.

6. The compressor of claim 5, wherein the sliding valve comprises:

a plurality of pressure devices positioned at both sides of the bypass hole that slidably contacts an inner circumferential surface of the valve hole, the plurality of pressure devices opening and closing the bypass hole by receiving the pressure from the back pressure switching device; and a connection device that connects the plurality of pressure devices to one another and includes a gas passage between an outer circumferential surface thereof and the valve hole.

7. The compressor of claim 6, wherein the valve spring is installed so that one of the plurality of pressure devices of the sliding valve closes the bypass hole when the sliding valve has the same pressure at both ends thereof.

8. The compressor of claim 7, wherein the plurality of pressure devices of the sliding valve is provided with a spring fixing groove for inserting the valve spring thereinto and fixing.

9. The compressor of claim 1, wherein the valve hole is provided with a first back pressure hole and a second back pressure hole connected to outlets of the back pressure switching device at both side surfaces thereof in a shaft direction.

10. The compressor of claim 1, wherein the pressure switching valve assembly comprises:

a switching valve housing that forms a high pressure side inlet connected to the gas discharge pipe, a low pressure side inlet connected to the gas suction pipe, the first outlet connected to the first connection pipe, and the second outlet connected to the second connection pipe;

a switching valve slidably coupled to inside of the switching valve housing that selectively connects the low pressure side inlet to the first outlet and the high pressure side inlet to the second outlet, or connects the low pressure side inlet to the second outlet and the high pressure side inlet to the first outlet;

an electromagnet installed at one side of the switching valve housing that moves the switching valve by an applied power; and an elastic member that restores the switching valve when the power applied to the electromagnet is cut off.

* * * * *